United States Patent [19]

Simons

[11] 4,111,095

[45] Sep. 5, 1978

[54] PERCUSSION INSTRUMENT MOUNTING APPARATUS

[76] Inventor: Steven R. Simons, 223 Golden Cir., Newport Beach, Calif. 92660

[21] Appl. No.: 847,731

[22] Filed: Nov. 2, 1977

[51] Int. Cl.[2] ..... G10D 13/00; G10D 13/06

[52] U.S. Cl. ..... 84/422 R; 248/125

[58] Field of Search ..... 84/422 R, 418, 402, 84/421; 248/125

[56] References Cited

U.S. PATENT DOCUMENTS

| | | | |
|---|---|---|---|
| 393,551 | 11/1888 | Foerster | 84/422 |
| 3,167,995 | 2/1965 | LaLonde | 84/422 |
| 3,548,068 | 12/1970 | Thompson | 84/422 |
| 3,893,363 | 7/1975 | Cohen | 84/421 |
| 4,028,984 | 6/1977 | Sanchez | 84/422 R |

*Primary Examiner*—L. T. Hix
*Assistant Examiner*—S. D. Schreyer
*Attorney, Agent, or Firm*—Graybeal, Barnard & Uhlir

[57] ABSTRACT

A percussion instrument mounting apparatus for mounting a second pair of cymbals or the like to a stand used for supporting and actuating a first pair of cymbals. Frame means connectible to the upper end portion of an upstanding tube assembly of the stand includes a lower spider element slidably encircling and fixedly connectable to the tube assembly, and also a three arm upper spider element superposed in coaxial alignment with the lower spider element. Each arm means includes (a) a lower arm pivotally connected at one end to the lower spider element and with a free end extending upwardly and radially outwardly from the lower spider element, and (b) an upper arm pivotally connected at one end to the upper spider element and with a free end extending downwardly and radially outwardly from said upper spider element. The upper and lower arms are pivotally connected together at a location intermediate the ends of both arms. Furthermore, the upper and lower arms are maintained in position to both span the first or lower cymbal pair and to support the lower cymbal of the second or upper cymbal pair by securing means located in the free end portions of the upper and lower arm. An extension rod is added to the pull rod of the existing stand to enable said lengthened pull rod to extend upwardly through the center of the upper spider means to support the upper cymbal of the second or upper cymbal pair.

11 Claims, 10 Drawing Figures

Fig. 1
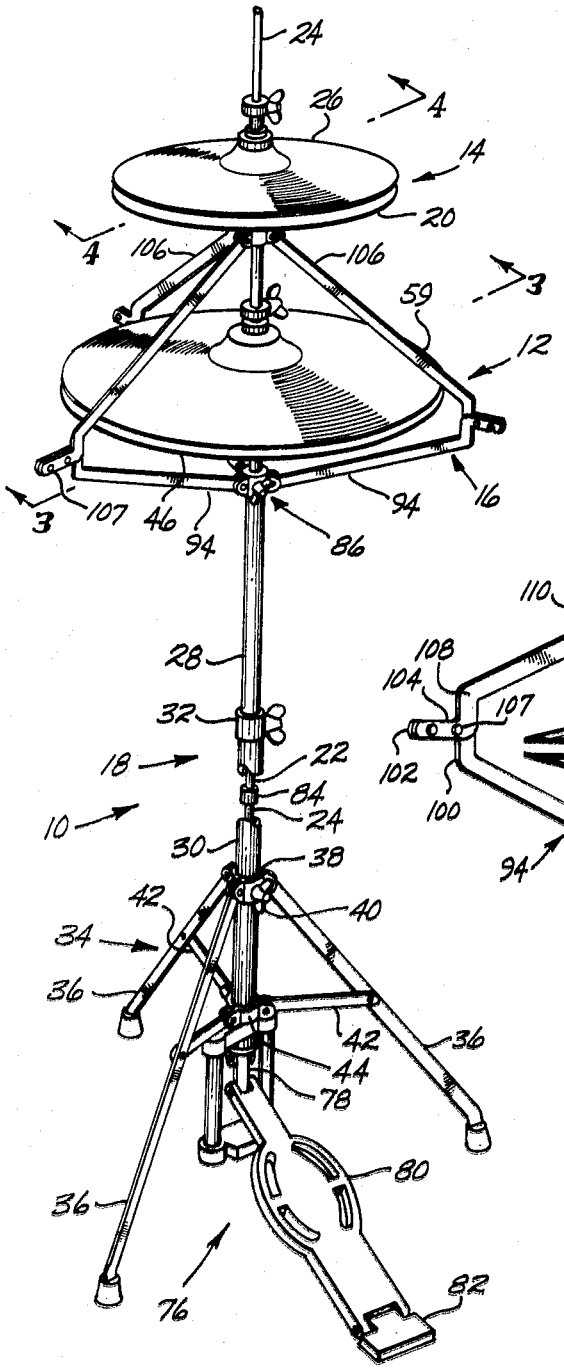
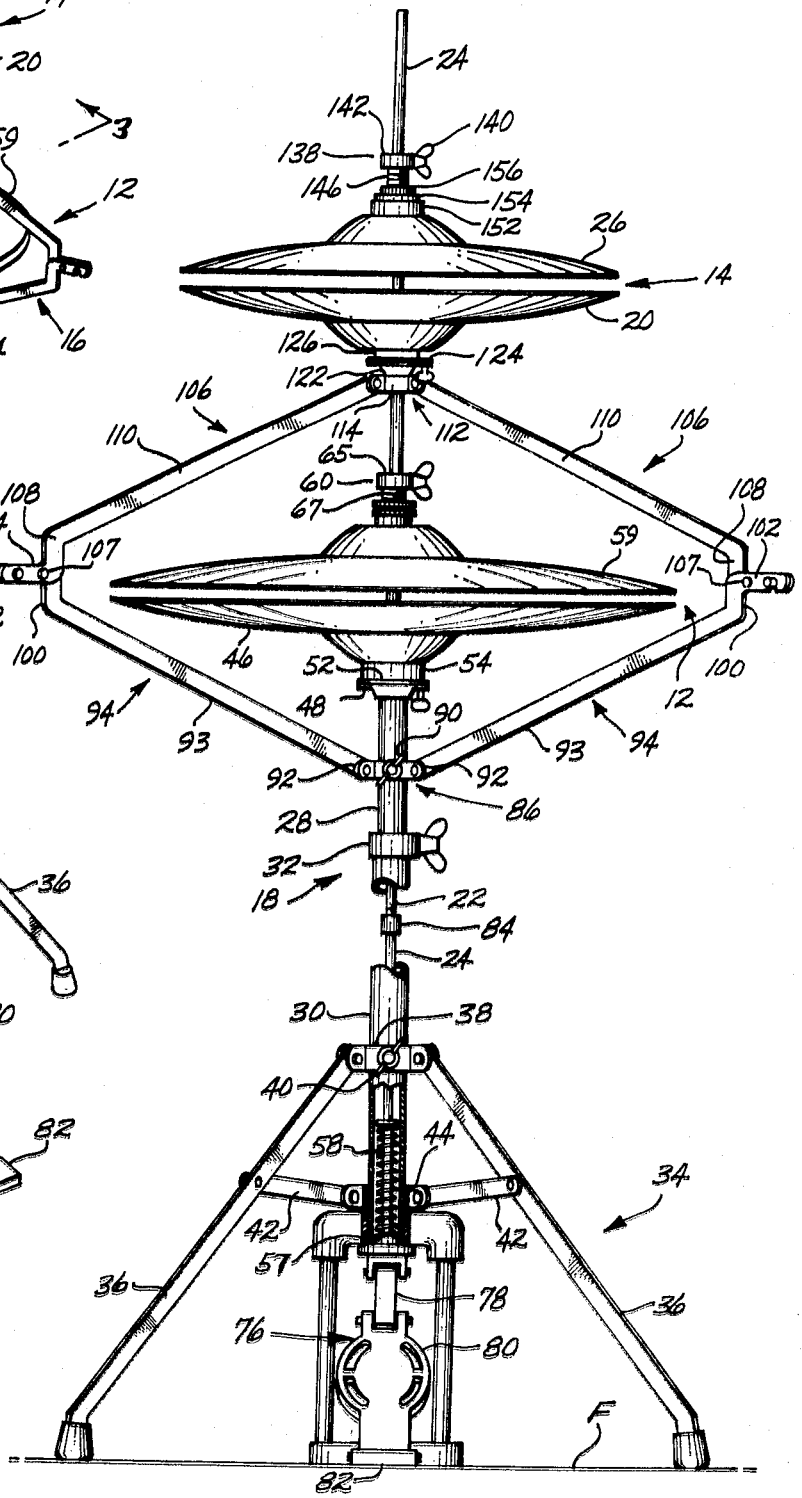
Fig. 2

Fig. 4
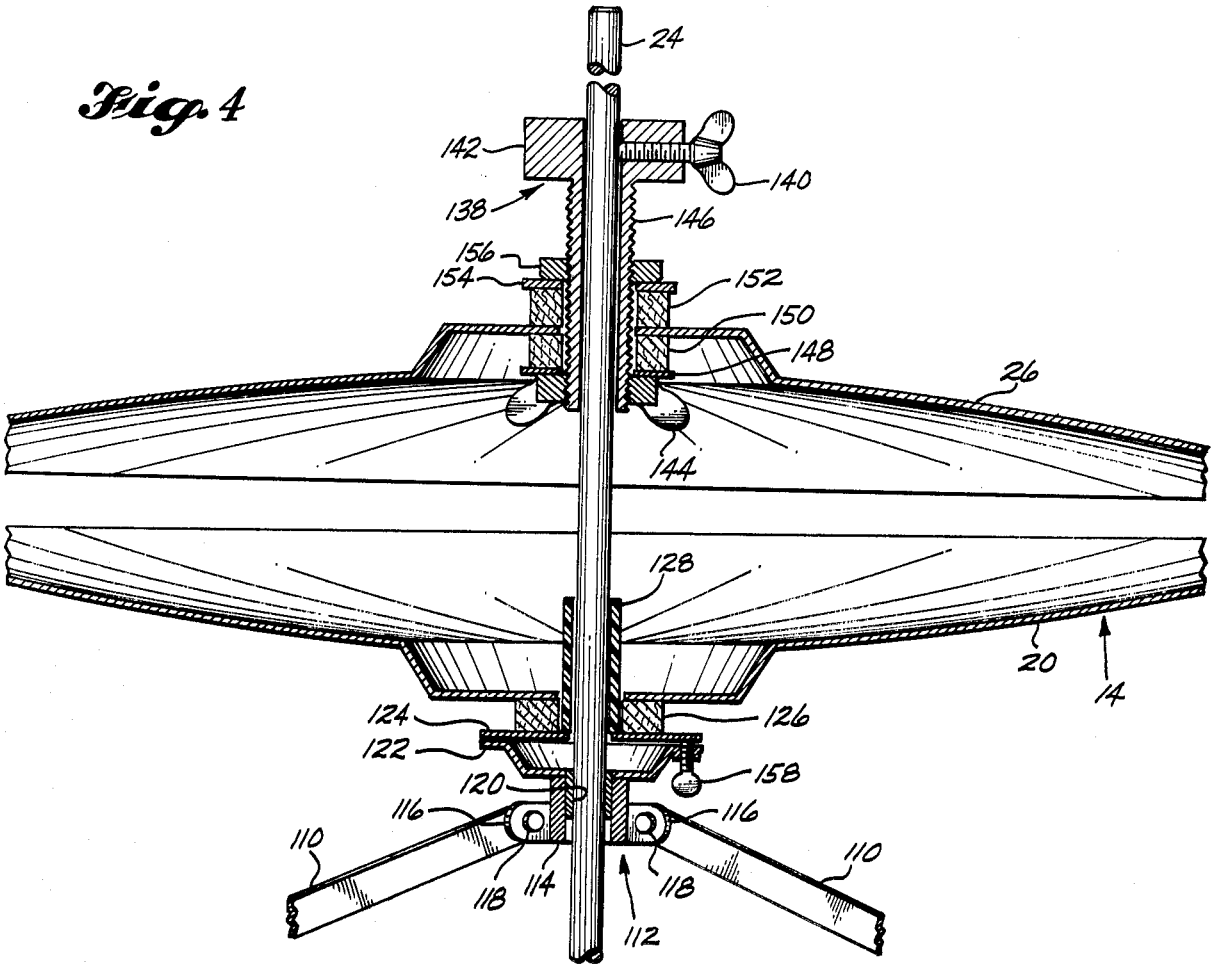
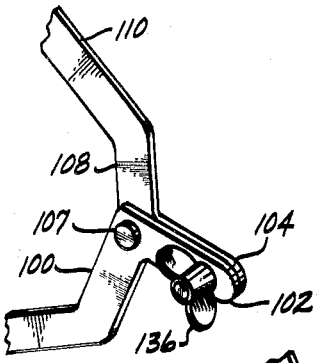
Fig. 6
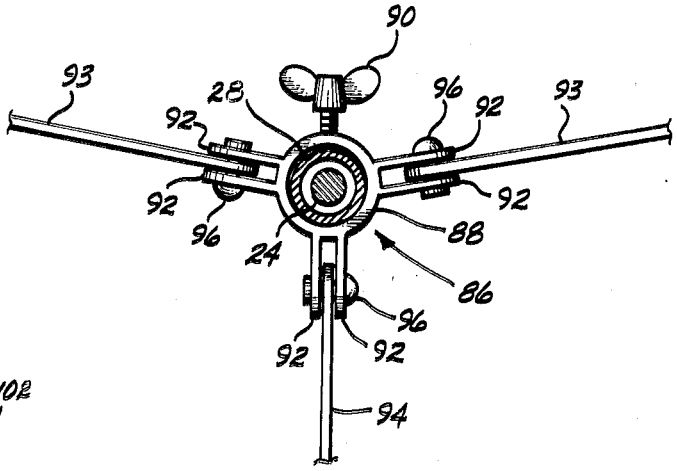
Fig. 5
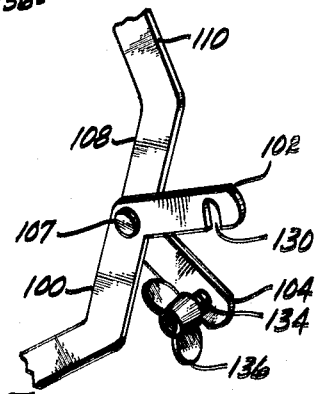
Fig. 7

PERCUSSION INSTRUMENT MOUNTING APPARATUS

BACKGROUND OF THE INVENTION

1. Field of the Invention

The present invention relates to stands for supporting and actuating percussion instruments, and more particularly to a support apparatus for mounting a second percussion instrument, such as a pair of cymbals, to a conventional stand for a first percussion instrument, such as a pair of cymbals.

2. Description of the Prior Art

Pairs of cymbals or so-called "high hats" are commonly used by musicians, especially drummers. The high hats are mounted on a vertical stand and have foot operated means to vertically displace the upper cymbal of the pair into and out of contact with the lower cymbal. "High hats" are usually used in conjunction with other musical instruments such as various types of drums and also various types of single cymbals, each mounted singularly on a stand. A bass drum, beaten by a foot actuated pedal beater, controlled by the musician's foot, is one type of drum instrument which is commonly played simultaneously with high hats.

Stands for supporting and actuating a single pair of cymbals are disclosed for example, by Ross, U.S. Pat. No. 3,185,014, by Meazzi et al, U.S. Pat. No. 3,464,305, by Blumenfeld, U.S. Pat. No. 3,481,239 and by Thompson, U.S. Pat. No. 3,548,068. In general, such stands consist of an upstanding tube supported by foldable legs in the form of a tripod, a springloaded pull rod guided within the tube and extending above the tube, and foot actuated means for longitudinally oscillating the pull rod. The bottom half of a cymbal pair is mounted stationarily on the upper end of the tube, and the upper cymbal of the pair is detachably connected to the rod so that when the rod is vertically oscillated within the tube, the cymbals are brought into and out of contact with each other.

A disadvantage of the known supporting and actuating mechanisms for "high hats" is that only one pair of cymbals can be played at a time. This limits the range of sounds which can be created by the musician, especially since only one foot is available to play the "high hat"; the other foot of course being used to play the base drum. Alternatively, if two separate high hats were mounted on individual stands, they would be very difficult and awkward to operate by one foot.

A stand for mounting a plurality of stationary percussion instruments is disclosed by Cohen U.S. Pat. No. 3,893,363. This stand consists generally of a multi-segmented rod which telescopes within an upstanding tube. Instruments, such as single cymbals, can be sandwiched between the adjacent segments of the rod. A horizontally disposed bar is mounted on the telescoping rod, and additional vertical rods for supporting individual instruments such as drums cymbals, temple block, and cow bells, in turn can be mounted on the horizontal rod. This particular stand has the obvious disadvantage of not enabling the musician to play instruments which must be displaced or shaken such as "high hats" or tambourines.

SUMMARY OF THE INVENTION

The instant invention relates to a novel apparatus for mounting a second percussion instrument such as a pair of cymbals to a stand for supporting and actuating a first percussion instrument, such as a pair of cymbals. Conventionally, the existing stand includes an upstanding, telescoping tube assembly supported by a tripod; a pull rod, the lower portion of which is guided within the tube assembly and; foot actuated means for reciprocating the pull rod lengthwise within the tube assembly. In basic form, the instant invention comprises an extension rod which is added to the existing stand pull rod so that a second percussion instrument can be mounted to the upper end of this thus extended pull rod. A lower spider element, which slidably encircles the upper half of the telescoping tube assembly, is releasably secured to such tube assembly. An upper spider element which slidably encircles the extended pull rod is supported colinearly with and above the lower spider element by a plurality of arm means rising upwardly from the lower spider element. The second percussion instrument, when disengaged from the extended pull rod assembly, can rest on the top of the upper spider element. Each of the arm means includes a lower arm having its lower end pivotally connected to the lower spider element, which lower arm when in second instrument supporting position, extends radially outwardly and upwardly from the lower spider element. Furthermore, each arm means includes an upper arm having its upper end pivotally connected to the upper spider element. The upper arm, when in second instrument supporting position, extends radially outwardly and downwardly. The lower arm and upper arms are pivotally connected at a location intermediate of the ends of both of said arms to form a scissors type element. To limit the minimum distance separating the upper and lower spider elements, but to still allow the two spider elements to be pulled apart so that the upper and lower arms can be extended to form a compact, elongated bundle for convenient storage and transportation, a generally vertical slot is located in the free portion of either the upper or lower arm and a horizontally disposed pin is cantilevered from the free end portion of the other opposite arm. When the upper spider element is pushed toward the lower spider element, the pin is received within the slot until the pin bears against the bottom of the slot.

It is a principal object of the present invention to provide a percussion instrument mounting apparatus to increase the range and variety of sounds which can be produced by a musician by enabling a second percussion instrument to be added to an existing stand used to support and actuate a first percussion instrument.

Another object of the present invention is to provide a percussion instrument mounting apparatus to enable two percussion instruments to be played simultaneously by a single foot operated actuating mechanism or to allow either percussion instrument to be played individually.

A further object of the present invention is to provide a percussion instrument mounting apparatus which can be easily and rapidly assembled on and disassembled from an existing stand without requiring any special tools or skilled labor.

An additional object of the present invention is to provide a percussion instrument mounting apparatus which, when not being used, can be folded into a compact unit for convenient transportation and storage.

BRIEF DESCRIPTION OF THE DRAWINGS

FIG. 1 is an isometric view of an embodiment of the percussion instrument mounting apparatus of the present invention shown installed on a typical conventional stand for a single pair of cymbals;

FIG. 2 is an elevational view of the percussion instrument mounting apparatus illustrated in FIG. 1;

FIG. 3 is a fragmentary cross-sectional view of the percussion instrument mounting apparatus shown in FIG. 1, taken substantially along lines 3—3 thereof, particularly illustrating the structure used for mounting the first percussion instrument;

FIG. 4 is a fragmentary cross-sectional view of the percussion instrument mounting apparatus illustrated in FIG. 1, taken substantially along the lines 4—4 thereof, especially depicting the structure used to mount the second percussion instrument;

FIG. 5 is an enlarged fragmentary cross-sectional view of a portion of the percussion instrument mounting apparatus shown in FIG. 3, taken substantially along line 5—5 thereof, and illustrating the angularly uneven spacing between the arm means thereof;

FIG. 6 is an enlarged fragmentary isometric view, illustrating the construction of the outer end portions of one set of upper and lower arms and FIG. 8 illustrates the construction of the outer end portions of the other two sets of upper and lower arms;

FIGS. 7 and 9 are enlarged fragmentary isometric views similar to FIGS. 6 and 8, respectively, except with the upper and lower arms pivoted relative to each other into a different position.

DESCRIPTION OF THE PREFERRED EMBODIMENT

Figures 3, 8, 9:
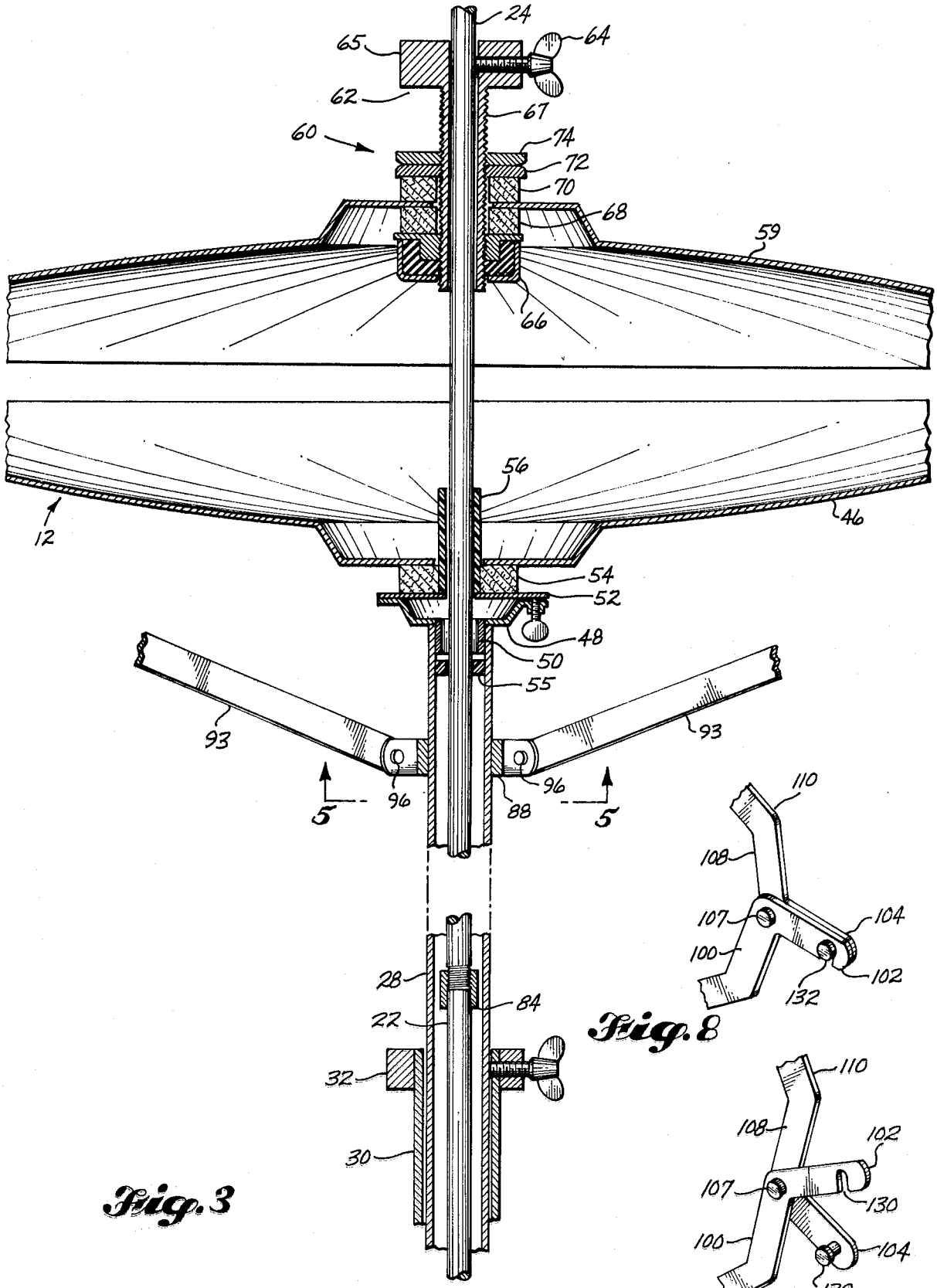

Referring initially to FIGS. 1 and 2, shown mounted on a conventional stand 10 for supporting and actuating a first or lower pair of cymbals 12 is a typical mounting apparatus for a second or upper pair of cymbals 14, constructed according to the instant invention. In preferred form, it comprises frame means 16 connectible to the upper end portion of upstanding tube assembly 18 of stand 10. Said frame means spans lower cymbal pair 12 to support coaxially above said lower pair of cymbals, the lower cymbal 20 of the upper pair of cymbals 14. An extension rod 22 is detachably connected between the two halves of pull rod 24 to extend the length of said pull rod so that the upper cymbal 26 of the upper cymbal pair 14 can be detachably connected thereto.

Again referring specifically to FIGS. 1 and 2, the illustrated stand 10 is a LUDWIG brand cymbal stand and is representative of conventional stands for a single pair of cymbals. Stand 10 includes a two-piece telescoping tube assembly 18 composed of a smaller diameter, upper tube 28 slidably receivable into a larger diameter, lower tube 30. Said two tubes are locked together by clamp 32. Tube assembly 18 is supported in upright position by retractable tripod assembly 34, which tripod assembly includes legs 36 pivotally connected at their upper ends to sliding collar 38 which encircles lower tube 30. A threaded wing bolt 40 extends through a tapped hole provided in sliding collar 38 and bears against lower tube 30 to maintain said sliding collar rigid therewith. To brace legs 36 in tube supporting position, one end of link 42 is pivotally connected to an intermediate portion of leg 36 and the other end of said link is pivotally connected to lower collar 44, which collar is fixed to the bottom end of lower tube 30.

Referring specifically to FIG. 3, the bottom cymbal 46 of lower cymbal pair 12 is shown supported by the upper end of upper tube 28. Specifically, base plate 48 is fixedly attached to internal sleeve 50 which in turn is pressed into the upper end portion of upper tube 28. A tilter plate 52 rests on top of base plate 48, which tilter plate in turn supports sleeve 56 and washer 54, on which cymbal 46 rests. Washer 54, being made from felt, serves to isolate cymbal 46 from tube assembly 18 and sleeve 56, being made from plastic, serves to isolate said cymbal from pull rod 24.

An elongate, two-piece pull rod 24 of circular cross section is guidably received within tube assembly 18 by upper bushing 55, FIG. 3, located immediately below internal sleeve 50, and by lower bushing 57, FIG. 2, pressed into the lower end portion of lower tube 30. Said pull rod extends from an elevation near the bottom of lower tube 30 upwardly to an elevation above upper tube 28. A compression spring 58, which is housed within lower tube 30, pushes upwardly on pull rod 24 to maintain said rod vertically positioned. As best shown in FIG. 3, as pull rod 24 extends upwardly from lower tube 30, it sequentially passes through clearance holes provided in base plate 48, tilter plate 52, and isolation sleeve 56, which parts are associated with bottom cymbal 46 of lower cymbal pair 12. The upper cymbal 59 of said lower pair of cymbals is supported in a position spaced above cymbal 46 by pull rod 24. Upper cymbal 59 is adjustably mounted on pull rod 24 by clutch means 60, which clutch means includes a collar 62 slidably encircling said pull rod and extending through a clearance hole provided in said cymbal. A wing screw 64 extends through a horizontal tapped hole provided in the upper end portion 64 of collar 62 and bears against pull rod 24 to thus clamp together said pull rod and said collar. An internally threaded connector assembly 66 is screwed onto the lower end of the externally threaded portion 67 of collar 62 to support sequentially lower felt washer 68, upper cymbal 59 and upper felt washer 70. A first serrated nut 72 is provided to clamp washers 68 and 70 together to thus securely attach upper cymbal 59 to collar 62. A second serrated nut 74 is provided to prevent loosening of first serrated nut 72.

As best shown in FIGS. 1 and 2, an actuating mechanism 76 is provided to displace pull rod 24 downwardly so that cymbal 59 can strike cymbal 46. Acutating mechanism 76 includes an articulated link 78 which interconnects the bottom end portion of pull rod 24 with the upper end of foot board 80. The lower end of said foot board 80 is pivotally connected to heel portion 82, which heel portion rests on he floor surface F. When a musician wishes to strike the two cymbals 46 and 59 together, he simply pushes downward on foot board 80 which causes pull rod 24 to be displaced downwardly until upper cymbal 59 strikes lower cymbal 46. When the musician removes the downward load from foot board 80, rod compression spring 58 pushes pull rod 24 upwardly to return upper cymbal 59 to its elevated position spaced above lower cymbal 46.

To the basic stand described above, is added the structure of the present invention which enables the second pair of cymbals 14 to be operated by the same actuating mechanism 76 which is used to operate the lower pair of cymbals 12. Referring specifically to FIG. 3, an extension rod 22 is added to pull rod 24 through the use of an internally threaded coupler 84 to extend the length of said pull rod. In a conventional percussion instrument stand such as stand 10, pull rods are usually constructed from two pieces which are connected together by a coupler such as coupler 84. This enables the pull rod to be disassembled into two shorter lengths for convenient storage and transportation. Because usually only one end of each half of pull rod 24 is threaded, extension rod 22, which is threaded at both ends is placed between the original two halves of said pull rod. It is to be understood that, rather than adding extension rod 22 to pull rod 24, other alternative methods of extending the length of pull rod 24 can be utilized, such as simply replacing the upper half of original pull rod 24 with a longer rod.

Referring now to FIGS. 1 and 2, frame means 16 is shown connected to upper tube 28 to support lower cymbal 20 of upper cymbal pair 14 at an elevation above lower cymbal pair 12. More specifically, said frame means includes a lower spider element 86, which lower spider element has a central collar 88 slidably encircling upper tube 28 of tube assembly 18, FIG. 5. A wing screw 90 extends through a threaded hole provided in the portion of collar 88 facing foot board 80, and bears against the outer surface of upper tube 28 to thus secure lower spider element 86 to said upper tube. Three pairs of lugs 92 extend horizontally radially outwardly from collar 88. Said lugs of each pair are disposed in spaced parallel relationship to receive therebetween the lower end portion 93 of lower arm 94. Said lower arm is pivotally attached between each pair of lugs 92 as by rivet means 96, which rivet means extends through aligned holes provided in each lug 92 and through a clearance hole provided in lower end portion 93 of lower arm 94.

As best shown in FIG. 2, lower end portion 93 of lower arm 94 extends upwardly and radially outwardly from lower spider element 86 to a location beyond the diameter of lower cymbal pair 12. From this point an intermediate portion 100 of lower arm 94 extends vertically upward, and then, a horizontally disposed upper or free end portion 102 extends radially outwardly.

Each lower arm 94 as illustrated in FIGS. 1, 2 and 6-9, is pivotally connected to the horizontally disposed lower or free end portion 104 of an upper arm 106 by a standard fastener such rivet means 107, which rivet means extends through aligned holes provided in upper end portion 102 of said lower arm and in lower end portion 104 of said upper arm. Upper arm 106, which is shaped similarly to lower arm 94, has an intermediate section 108 rising vertically upwardly from lower end portion 104 and also has an upper end portion 110 extending generally upwardly and radially inwardly from said intermediate portion to be pivotally connected to an upper spider element 112. Said upper spider element has a collar portion 114 and also has three pairs of lugs 116 extending radially outwardly from said collar portion at locations corresponding to the location of lugs 92 of lower spider element 86. Lugs 116 of each pair are spaced apart in close parallel relationship to pivotally receive therebetween upper end portion 110 of upper arm 106. Rivets 118 extend through aligned holes provided in lugs 116 and through a clearance hole provided in upper arm portion 110.

As illustrated in FIG. 5, the three pairs of lugs 92 are preferably unevenly spaced around the circumference of collar 88 so that the pairs of pivotally joined lower and upper arms 94 and 106, respectively, span lower cymbal pair 12 to define one larger opening and two smaller openings. The larger opening, preferably located toward foot board 80, is provided to enable lower cymbal pair 12 to be easily removed when stand 10 is disassembled for storage and/or shipment, and to facilitate the user's access to the upper cymbal of the lower cymbal pair for striking thereof by a drumstick, if so desired.

Lower cymbal 20 of upper cymbal pair 14 is supported by upper spider element 112 such that said lower cymbal is both coaxially aligned with, and spaced above, lower cymbal pair 12, FIG. 4. More specifically, sleeve 120, which closely and slidbly encircles pull rod 24, is both pressed to the upper end portion of collar 114 of upper spider element 112 and is fixedly attached to circular, dished base plate 122. Said base plate rests on the upper end of collar 114 and in turn supports circular tilter plate 124. A washer 126 is interspaced between the top surface of tilter plate 124 and the bottom surface of cymbal 20 to isolate the two parts, and a bushing 128 extends through a clearance hole provided in the center of cymbal 20 and encases pull rod 24 to separate said two parts. Washer 126 is preferably of vibration absorbing material such as felt, and bushing 128 is preferably of low friction coefficient material such as plastic.

Securing means are illustrated in FIGS. 6-9 for limiting the minimum distance separating lower spider element 86 from upper spider element 112. The upper end portion 102 of lower arm 94 is provided with a downwardly open slot 130 as shown in FIGS. 8 and 9, in two of the three upper arms 106, a pin, such as rivet 132, extends horizontally outwardly from the lower end portion 104 towards upper end portion 102 of the corresponding lower arm 94. In the third upper arm 106, preferably the upper arm opposite foot board 80, a threaded pin 134 is used in the place of rivet 132, FIGS. 6 and 7. When frame means 16 is in position to support upper cymbal pair 14, rivets 132 and threaded pin 134 are received within slot 130 and bear against the end of said slot to thus prevent any downward movement of upper spider element 112 in respect to lower spider element 86. Furthermore, a wing nut 136, as shown in FIGS. 6 and 7, is engaged with the threaded end of pin 134 to frictionally clamp together the upper end portion 102 of lower arm 94 and the lower end portion 104 of upper arm 106 to prevent said two arms from being pivoted relative to each other.

It is to be understood that, rather than constructing the frame means from sets of pivotally joined together lower lower arms 94 and upper arms 106, said two arms may be replaced by rigid, one piece arms. This particular construction would, however, increase the bulkiness of the apparatus since the one piece arms could not be extended into a compact bundle as is possible with the two-piece arms sets, as will be described below.

Upper cymbal 26 of upper cymbal pair 14, as shown in FIGS. 1, 2 and 4, is mounted on pull rod 24 through collar 138, which collar slidably encircles said pull rod. More particularly, the threaded shank of thumb screw 140, extending through a horizontally disposed threaded hole provide in the upper end portion 142 of collar 138, bears against pull rod 24 to maintain collar 138, and thus upper cymbal 26, rigidly connected to said pull rod. A thumb nut 144 is engaged with the lower end of threaded portion 146 of collar 138. A flat washer 148 is located above thumb nut 144, which flat washer in turn supports two isolation washers 150 and 152 with upper cymbal 26 sandwiched therebetween. Preferably, said isolation washers are of vibration absorbing material, such as felt. Next, a first nut 154 is provided to compress isolation washers 150 and 152 together to securely hold upper cymbal 26 therebetween. Lastly, a second nut 156, which is utilized as a locking nut, and bears tightly against the top surface of first nut 154 to prevent said first nut from becoming loosened.

To operate upper cymbal pair 14, pressure is applied to foot board 80 to cause pull rod 24 to be displaced downwardly until upper cymbal 26 strikes against lower cymbal 20. To alter the sounds produced by the clashing together of upper cymbal 26 and lower cymbal 20, said two cymbals can be askewed relative to each other so that the entire perimeters of said two cymbals do not contact each other simultaneously, but rather, progressively contact each other. This askewed relationship between upper cymbal 26 and lower cymbal 20 is obtained by utilizing thumb screw 158 to tilt tilter plate 124 in respect to base plate 122. The threaded portion of thumb screw extends upward through a threaded hole provided in base plate 122 to bear upwardly against the lower surface of tilter plate 124. Thus, the sounds created by upper cymbal pair 14 can be progressively altered by adjusting the degree which lower cymbal 20 is tilted in respect to upper cymbal 26.

It is to be understood that the present invention is not limited only to mounting cymbal pairs to existing stand 10. Other percussion instruments, such as a tambourine, can also be thus mounted on stand 10.

Figure 10:
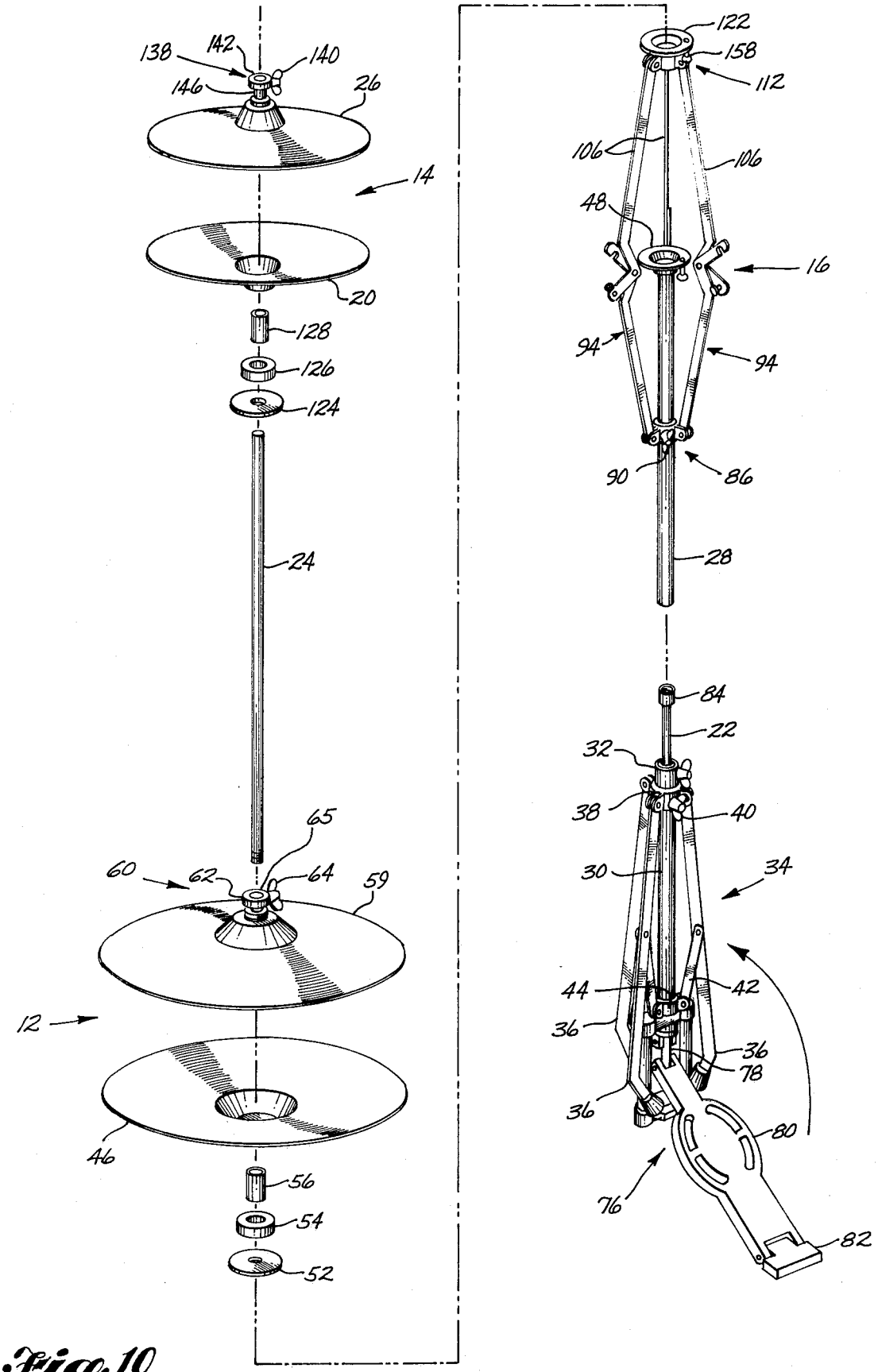
FIG. 10 is an exploded isometric view of the percussion instrument mounting apparatus similar to that shown in FIG. 1, illustrating an embodiment of the present invention disassembled for convenient transportation and storage.

Stand 10, with the permission instrument mounting apparatus of the present invention mounted thereupon, can be easily disassembled for compact storage and transportation. Referring to FIG. 10, thumb screw 140 of upper cymbal 26 of upper cymbal pair 14 is initially loosened so that said cymbal can be lifted upwardly and disengaged from pull rod 24. Then, lower cymbal 20 of upper cymbal pair 14, together with bushing 128, washer 126, and tilter plate 124, are removed from the top of base plate 122. Next, thumb screw 64 of collar 62 is loosened so that upper cymbal 59 of the lower cymbal pair 12 can be slid downward along pull rod 24 to rest on top of the corresponding lower cymbal 46. The upper half of pull rod 24 is then unscrewed from connector 84, FIG. 3, and upwardly removed. Thereupon, lower cymbal pair 12, along with sleeve 56, washer 56 and tilter plate 52, can be withdrawn from base plate 48 through the larger opening created by the two sets of joined together upper and lower arms 106 and 94, respectively, nearest foot board 80. Next, clamp 32 is loosened and upper tube 28, along with frame means 16, is slidably removed from lower tube 30. Thereafter, wing nut 136 is loosened so that upper spider element 112 can be pulled away from lower spider element 86 to thus straighten lower arms 94 and upper arms 106 in respect to each other to form an elongated compact bundle. If desired, wing screw 90 in lower spider element 112 can be loosened so that upper tube 28 can be removed from frame means 16; however, such removal is not required. Wing screw 40 of sliding collar 38 is unscrewed to enable legs 36 of tripod assembly 34 to be retracted upwardly along the length of lower tube 30. Finally, foot board 80, together with heel portion 82, is pivoted upwardly toward lower tube 30 to thus create a compact bundle with said lower tube and with tripod assembly 34. The disassembly procedure can of course vary slightly depending on the particular make of stand 10 being used.

To assemble stand 10 and to mount the apparatus of the present invention thereupon, foot board 80 and heel portion 82 are first pivoted downwardly until side heel portion rests on surface F. Next, tripod assembly 34 is extended to support upright lower tube 30 of tube assembly 18. With frame means 16 in the retracted position, as shown in FIG. 10, upper tube 28 is extended through lower spider element 86 of said frame means and is then engaged downwardly into lower tube 30 until the desired elevation of lower cymbal 46 of lower pair 12 is reached and then clamp 32 is tightened. Upper spider element 112 of frame means 16 is then pushed downwardly toward lower spider element 86 until rivets 132 (FIGS. 8 and 9) and threaded pin 134 (FIGS. 6 and 7) bear against the end of slots 130. Wing nut 136, FIGS. 6 and 7, is first tightened to maintain frame means 16 rigid, and then lower spider element 86 is positioned along the height of upper tube 28 until the desired elevation of lower cymbal 20 of upper cymbal pair 14 is reached. Lower cymbal pair 12 is next mounted upon the upper end of tube 28. Thereafter, pull rod 24 is slid downwardly sequentially through upper spider element 112, lower cymbal pair 12 and upper tube 28, and is then fastened to extension rod 22, FIG. 3. Lastly, upper cymbal pair 14 is placed upon upper spider element 112. The spacing between the upper cymbal and lower cymbal of each cymbal pairs 12, 14 is adjusted by depressing foot board 80, causing pull rod 24 to move downwardly. With the board 80 thus depressed, wing screw 64 of cymbal 59 and wing screw 140 of cymbal 26 are both tightened so that when the downward force on foot board 80 is removed, the upper cymbal 59 and 26 are essentially the same distance above the corresponding lower cymbal 46 and 20, respectively. To render either upper cymbal pair 14 or lower cymbal pair 12 inoperative, the corresponding wing screw 64 or 140 is loosened so that the associated upper cymbal 59 or 26, respectively, is disengaged from pull rod 24 and rests on the lower cymbal of the pair.

What is claimed is:

1. For use with a stand for supporting and actuating a first percussion instrument, which stand includes an upstanding tube assembly, a pull rod partially housed within and extending above such tube assembly, and means for reciprocating such pull rod lengthwise within such tube assembly; an apparatus for mounting a second percussion instrument on the stand and enabling such two percussion instruments to either be played simultaneously or individually, such second percussion instrument support apparatus comprising:

(a) an extension rod which is detachably connectable to the pull rod to extend the length of the pull rod, a portion of the second percussion instrument being attachable to said extended pull rod; and (b) means connectable to the stand for supporting another portion of the second percussion instrument both stationary in respect to the stand and at an elevation above the first percussion instrument.

2. A second percussion instrument mounting apparatus according to claim 1, wherein said supporting means includes:

(a) a lower spider element slidably encircling the tube assembly, said lower spider element being releasably securable to the tube assembly, (b) a plurality of arm means each connected at one end portion to said lower spider element, each of said arm means extending generally upwardly from said lower spider element and also extending radially outwardly to partially encircle the first percussion instrument; and (c) an upper spider element for supporting another portion of the second percussion instrument, said upper spider element slidably encircling said extended pull rod and being connected to the end of each of said arm means opposite said lower spider element.

3. A second percussion instrument mounting apparatus according to claim 2, including three arm means, said three arm means being angularly unevenly spaced around the longitudinal axis of the tube assembly to provide an opening formed by two of said three arm means of a size large enough to permit the first percussion instrument to pass laterally therebetween.

4. A percussion instrument mounting apparatus according to claim 2, wherein each of said arm means includes:

(a) a lower arm having one end portion pivotally connected to said lower spider element, said lower arm, when in second instrument supporting position, having a free end portion located radially outwardly and upwardly from said lower spider element;

(b) an upper arm having one end portion pivotally connected to said upper spider element, said upper arm, when in second instrument supporting position, having a free end portion located radially outwardly and downwardly from said upper spider element;

(c) means for pivotally connecting together said lower and upper arms at a location intermediate of the ends of both said upper and lower arms; and (d) securing means for rigidly maintaining said lower and upper arms in second instrument supporting position.

5. A percussion instrument mounting apparatus according to claim 4, including three sets of said conncted together upper and lower arms angularly spaced around the circumference of said upper and lower spider elements.

6. A second percussion instrument mounting apparatus according to claim 4, wherein said securing means comprising a generally vertically disposed slot located in said free end portion of one of said upper and lower arms of each of said arm means; and a horizontally disposed pin cantilevered from said free end portion of the other of said upper and lower arms of each of said arm means to extend toward said slot, said pin being receivable within said slot and bearing against the end of said slot to maintain said upper and lower spider elements spaced apart.

7. A second percussion instrument mounting apparatus according to claim 6, and locking means to prevent said upper and lower spider elements from moving relative to each other, said locking means including a threaded free end in said pin of one of said arm means, and nut means to engage with said threaded pin to frictionally lock said upper and lower arms of one of said arm means together.

8. In a stand for supporting and actuating a first pair of cymbals, which stand comprises an upstanding, telescoping tube assembly with the upper end of such tube assembly supporting the lower cymbal of the first pair of cymbals, an elongate pull rod having its lower end portion slidably guided within the tube assembly and having its upper end portion detachably connectable to the upper half of the first pair of cymbals, and foot actuated means for reciprocating the pull rod upwardly and downwardly within such tube assembly to move the upper and lower cymbals of the first pair of cymbals into and out of contact with each other; an apparatus for mounting a second pair of cymbals on such stand, said second cumbal pair mounting apparatus comprising:

(a) an extension rod connectable to the pull rod for increasing its length, said extended pull rod being detachably connectable to the upper half of the second pair of cymbals; and (b) frame means for supporting the lower cymbal of the second pair of cymbals stationary in respect to, coaxially aligned with and at an elevation above the lower said cymbal of the first pair of cymbals, second cymbal pair support apparatus enabling the first and second pairs of cymbals to be operated simultaneously and to alternatively allow selective use of either pair of cymbals of disengaging the upper cymbal of the non-operating pair of cymbals from said extended pull rod.

9. A second cymbal of pair mounting apparatus according to claim 8, wherein said frame means comprises:

(a) a lower spider element slidably encircling the tube assembly, said lower spider element being securable to such tube assembly, (b) an upper spider element for supporting the lower cymbal of the second pair of cymbals, said upper spider element slidably encircling said extended pull rod, and (c) a plurality of arm means for interconnecting said lower and upper spider element, each of said arm means being shaped for spanning the first pair of cymbals.

10. In combination, (a) a first pair of cymbals, (b) a second pair of cymbals, (c) support means on which said pairs of cymbals are arranged coaxially, one pair above the other, and with upper and lower cymbals of each pair, facing one another in slightly spaced relation, said support means including (1) a floor engaging stand including vertical tube means with respect to which the lower cymbals of both pairs of cymbals are stationarily supported, (2) rod means arranged axially with respect to such vertical tube means and on which both of the upper cymbals of both pairs of cymbals are supported, (3) spring means normally biasing said rod means to an upper position within said tube means, and (d) means for moving said rod means downwardly with respect to said tube means and causing simultaneous striking of the lower cymbals of the cymbal pairs by the upper cymbals thereof.

11. The combination of claim 10, wherein each of the upper cymbals of the cymbal pairs includes a thumb screw means readily manipulatable either to attach the cymbal to said rod means or to release the cymbal from said rod means.

* * * * *